United States Patent [19]

Martin

[11] Patent Number: 4,580,357

[45] Date of Patent: Apr. 8, 1986

[54] SKIING BOOT

[76] Inventor: Hans Martin, Chasernweg 7, Kloten, Switzerland

[21] Appl. No.: 636,974

[22] Filed: Aug. 2, 1984

[30] Foreign Application Priority Data

Aug. 3, 1983 [CH] Switzerland ..... 4224/83

[51] Int. Cl.[4] ..... A43B 5/04

[52] U.S. Cl. ..... 36/118; 36/54; 36/119

[58] Field of Search ..... 36/117–121, 36/54

[56] References Cited

U.S. PATENT DOCUMENTS

| | | | |
|---|---|---|---|
| 3,855,716 | 12/1974 | Hutchinson | 36/119 |
| 3,883,964 | 5/1975 | Check | 36/119 |
| 4,192,087 | 3/1980 | Salomon | 36/119 |
| 4,196,530 | 4/1980 | Delery | 36/119 |
| 4,280,286 | 7/1981 | Sartor | 36/118 |
| 4,406,073 | 9/1983 | Spademan | 36/119 |
| 4,470,206 | 9/1984 | Annovi | 36/119 X |
| 4,534,122 | 8/1985 | MacPhail | 36/119 X |

FOREIGN PATENT DOCUMENTS

| | | | |
|---|---|---|---|
| 3236259 | 4/1983 | Fed. Rep. of Germany | 36/119 |
| 433055 | 9/1967 | Switzerland | 36/119 |

*Primary Examiner*—James Kee Chi

*Attorney, Agent, or Firm*—Bachman & LaPointe

[57] ABSTRACT

The upper part of the skiing boot has a cap part and a leg, the latter having a tibia side leg portion and a calf side leg portion. Between the tibia side leg portion and an inner boot is provided a support member which, on drawing together the two leg portions, exerts on the instep part the pressure necessary for tightening the skiing boot. Compared with known tightening devices, this leads to a much simpler solution for the same pressing force action in the instep region.

17 Claims, 2 Drawing Figures

SKIING BOOT

BACKGROUND OF THE INVENTION

The present invention relates to a skiing boot comprising a lower part provided with a sole and an upper part connected to the lower part, the upper part having a cap part and a leg.

In the case of skiing boots, in which both the upper part and the lower part are almost exculsively made from plastic, it is known to facilitate the introduction and removal of the skier's foot with respect to the skiing boot by separating the calf-side part of the leg from the remainder of the latter and constructing it as a calf part pivotably mounted in the heel area. This calf part is held together with the remainder of the leg part by at least one drawstring.

In a known skiing boot of this type (see U.S. Pat. No. 3,975,838), the pivotable calf part is drawn by a tightening strap fixed to the tibia-side part of the leg against the calf and is held together with the remainder of the leg. The drawing together or tightening and the complete, playfree pressing of the boot against the skier's foot, particularly in the vicinity of the instep, is brought about by means of a tightening device having a tightening member and arranged on the tibia side. The tightening device tightens a tightening cable running in zig-zag manner over the instep and consequently brings about the drawing together and pressing of the instep region of the skiing boot against the skier's foot.

In another known skiing boot, (U.S. Pat. No. 3,793,749), a pivotable calf part, which is also separate from the boot leg is provided and is drawn against the calf by a tightening strap fixed to the tibia side part of the leg. However, unlike in the first-mentioned construction, no use is made of a tibia side tightening device, in order to produce the tension required for a smooth tightening of the skiing boot in the instep region. Instead a pressing and tightening part is arranged in the instep region and this is connected by at least one tightening cable to the pivotable calf part. This connection, in which the tightening cable is connected in the heel area to the pivotable calf part ensures that on pivoting the latter against the skier's calf and by tightening the tightening strap, the tightening cable is tensioned. Thus, the instep side pressing and tightening part is firmly drawn onto the instep and onto the skier's foot, leading to the complete, playfree connection between the skiing boot and the skier'foot in the instep region which is necessary when skiing.

The common feature of the two aforementioned, known constructions is a tensioning member, which transfers the tightening movement for the complete playfree tensioning of the skiing boot in the instep part. In these two constructions, the tensioning or tightening element is at least one tightening cable guided by means of guides, and which is operated in the first-mentioned construction by the tightening device of the tibia side and in the second-mentioned construction by the pivotable calf part. The tightening cable with its two guides, which are either constructed as Bowden wires or as a cable positioned in guidance slots, constitutes a relatively complicated and costly component of the skiing boot, which also requires careful fitting, because the length of the tightening cable must be adaptable to different foot shapes.

SUMMARY OF THE INVENTION

It is the principal object of the present invention to develop a skiing boot of the aforementioned type where it is possible to tighten the boot in the instep region without any tightening cable but in an equivalent manner to that provided by such a cable.

According to the present invention the foregoing object is achieved wherein a dimensionally rigid support body extends both over part of the instep and over part of the tibia and is held on the tibia part by a tightening strap which passes around and draws together the leg part, accompanied by the pressing of the support member against the same. Thus, the pressing of the support member, particularly in the transition region between the tibia part and the instep part is brought about by the tightening strap, without any need for an additional tightening member.

BRIEF DESCRIPTION OF THE DRAWINGS

The invention is described in greater detail hereinafter relative to a non-limitative embodiment and the attached drawings, wherein.

DETAILED DESCRIPTION

Figure 2:
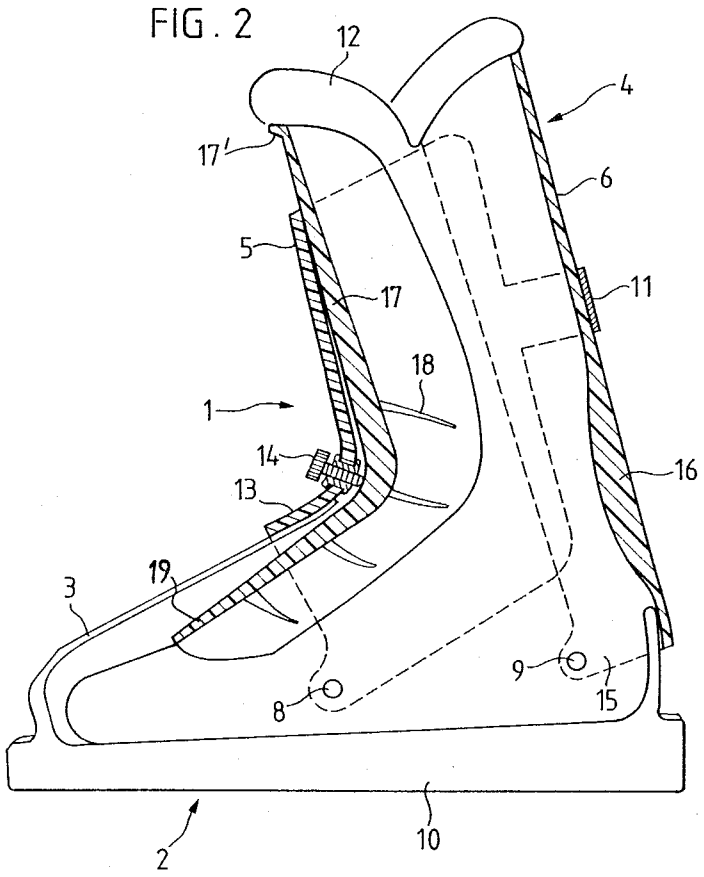
FIG. 2 is a vertical longitudinal section through the skiing boot of FIG. 1, but after the tightening strap has been tightened.
Figure 1:
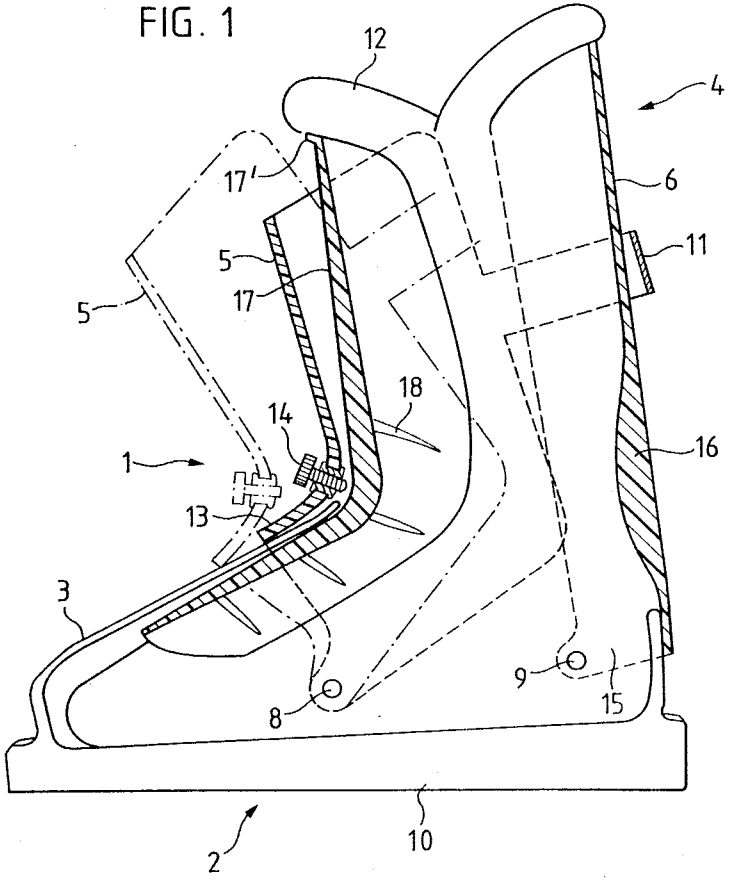
FIG. 1 is a vertical longitudinal section through a skiing boot prior to the tightening of the tightening strap.

The skiing boot shown in the FIGS. 1 and 2 has an upper part 1 and a lower part 2. The upper part 1 comprises a cap part 3, which extends against the instep part, and a leg 4, the latter being constructed in two parts, namely a tibia side leg portion 5 and a calf side part 6. The tibia side leg portion 5 is pivotably mounted about a pivot pin 8 which is at right anlges to the longitudinal plane of the skiing boot and the calf side leg part 6 is pivotably mounted about a pivot pin 9 located in the heel area and running parallel thereto.

The lower part 2 has a sole 10, while any fittings on the cap or heel have been omitted for reasons of simplicity.

The tibia side leg portion 5 is provided with a tightening strap 11, which is equipped with a not shown clasp enabling the two leg portions 5 and 6 to be drawn together, so that an inner boot 12 in the inner area of upper part 1 is completely engaged around the skier's leg by the tightening strap 11. On the instep side, the tibia side leg portion 5 has an extension 13 and in the transition region between the leg and the instep part 19 is provided a tightening device 14, that is, a tightening screw.

The calf side leg portion 6 has towards the heel end 15, a material reinforcement 16, which imparts a greater rigidity to portion 6. Reinforcement 16 can be designed in various ways and can be in the form of ribs, beads, or thickened wall portions. Wall reinforcement 16 serves to prevent any inadmissible shape change as a result of the force exerted by the tightening strap 11.

Between the tibia side leg portion 5 and the inner boot 12 is placed a dimensionally rigid support member 17, which extends over part of the instep and over part of the tibia. The term "dimensionally rigid" is understood to mean a shape in which substantially no or only small elastic deformations can occur. In particular support member 17 must be in a position, after its edge 17' has been initially supported on the tibia and tightened from the underlying tightening strap 11, to engage in the same way with the instep side part. FIGS. 1 and 2, support member 17, which is essentially constructed as a reinforced shell part, is made from plastic and in order to increase its dimensional rigidity is provided with reinforcing beads or ribs 18. However, it would also be possible to make support member 17 from metal, in such a way that it also engages with the tibia and instep and can elastically deform as a result of the forces which occur.

FIG. 1 shows the insertion of support member 17 and the start of the tightening process. On introducing the foot into the skiing boot, the tibia side leg portion 5 is in the dot-dash line position. After engaging support member 17 on inner boot 12, the tibia side part 5 is moved against the tibia and is completely pressed against the support member 17 with the aid of the tightening strap 11 in the manner shown in FIG. 2. Due to the fact that the support member engages completely with the tibia, the instep side part of support member 17 presses against the instep part of the foot, see FIG. 2, which shows the position of the instep side part of support member 17 remote from cap part 3. As a result of this pivoting movement, support member 17 produces the same pressing action, as if it had been tightened by the tightening cable as used in the prior art constructions.

As a result of a tightening device 14, e.g. a tightening screw, it is also possible to sensitively adjust the pressing force which occurs.

Support member 17 not only ensures in a very simple manner the pressing force necessary for skiing on the instep area of the skier's foot, but also permits further simplifications. For example, there is no need for the pivotability of the calf side leg portion 6, because in the case of adequate pivotability of the tibia side leg portion 5, insertion of the foot is also possible without pivoting the tibia side leg portion.

A further simplification could be achieved by not having the tibia side leg portion and by directly fixing the tightening strap 11 to the tibia side part of support member 17, which then forms the tibia side leg portion.

If the tibia side leg portion 5 is used for securing the support member 17, the latter can possibly be constructed without any mounting support on pivot pin 8, if it can be held in position by tightening strap 11. If the support member 17 is used without a tibia side leg portion 5, its position is ensured by the tightening strap 11, suitable means preventing its upward sliding. Finally, support member 17 could be held in position by resilient mounting support anchored in the vicinity of pivot pin 8.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A skiing boot for skiers comprising a lower part having a sole and an upper part connected to the lower part, said upper part having a cap part, instep part and a leg, said leg having a calf side part and a tibia side leg portion arranged above the cap part, a dimensionally rigid support member positioned beneath said tibia side leg portion and having a portion extending over part of the instep part and a portion extending over the skier's tibia, and means for holding said rigid support member against the skier's tibia and drawing together the tibia side leg portion and the calf side part about the skier's leg.

2. A skiing boot according to claim 1 wherein the support member is positioned beneath a tibia side leg portion arranged above the cap part wherein said means for holding said support member is fixed to said tibia side leg portion.

3. A skiing boot according to claim 2 wherein said means for holding said support member is a tightening strap.

4. A skiing boot according to claim 2 wherein the tibia side leg portion is pivotably fixed to the cap part by a horizontal pivot pin.

5. A skiing boot according to claim 2 wherein the tibia side leg portion extends over a portion of the instep part.

6. A skiing boot according to claim 1 wherein the support member is a shell part having the portion over the instep part angled towards the portion over the skier's tibia.

7. A skiing boot according to claim 6 wherein the support member is reinforced so as to improve the dimensional rigidity of the shell part.

8. A skiing boot according to claim 7 wherein the support member is reinforced by ribs.

9. A skiing boot according to claim 7 wherein the support member is reinforced by beads.

10. A skiing boot according to claim 7 wherein the support member is reinforced by thickened walls.

11. A skiing boot according to claim 2 wherein the tibia side leg portion has an adjusting device for adjusting the pressure exerted by the support member.

12. A skiing boot according to claim 11 wherein said adjusting device is an adjusting screw.

13. A skiing boot according to claim 12 wherein said calf side part is reinforced in the vicinity of the heel.

14. A skiing boot according to claim 13 wherein said calf side part is reinforced in the vicinity of the beads.

15. A skiing boot according to claim 13 wherein said calf side part is reinforced in the vicinity of the ribs.

16. A skiing boot according to claim 13, wherein said calf side part is reinforced in the vicinity of the thickened walls.

17. A skiing boot according to claim 13 wherein said calf side part is held to said leg by said means for holding said support member to said tibia side leg portion.

* * * * *